US006487385B2

(12) United States Patent
Yoshii et al.

(10) Patent No.: US 6,487,385 B2
(45) Date of Patent: Nov. 26, 2002

(54) LIQUID ELECTROPHOTOGRAPHIC IMAGING SYSTEM WITH A MAXIMIZED SOLID TONER RATIO

(75) Inventors: Tomoyuki Yoshii, Tokyo (JP); Yasuhiro Funayama, Tokyo (JP); Jun Koyatsu, Niigata (JP); Tsutomu Uezono, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/821,514

(22) Filed: Mar. 29, 2001

(65) Prior Publication Data

US 2001/0031157 A1 Oct. 18, 2001

(30) Foreign Application Priority Data

Mar. 30, 2000 (JP) ..... 2000-095048

(51) Int. Cl.[7] ..... G03G 15/10
(52) U.S. Cl. ..... 399/239; 399/249
(58) Field of Search ..... 399/237, 239, 399/249

(56) References Cited

U.S. PATENT DOCUMENTS 3,907,423 A * 9/1975 Hayashi et al. ..... 399/249
4,161,361 A * 7/1979 Soma et al. ..... 399/249
4,400,079 A * 8/1983 Landa ..... 399/249 X
5,561,264 A * 10/1996 Iino et al. ..... 399/249 X
5,666,615 A * 9/1997 Nguyen ..... 399/249 X
6,146,804 A * 11/2000 Miyamoto et al. ..... 399/237 X
6,314,253 B1 * 11/2001 Hosoya et al. ..... 399/249 X

FOREIGN PATENT DOCUMENTS

JP 6-186859 7/1994 ..... G03G/15/10

* cited by examiner

*Primary Examiner*—Fred L. Braun
(74) *Attorney, Agent, or Firm*—Michael Best & Friedrich, LLC

(57) ABSTRACT

A liquid electrophotographic developing apparatus capable of preventing image drift and reducing the load in the squeezing process. A developing roller faces a photoreceptor belt with a predetermined spacing to supply a liquid developer to the photoreceptor belt while rotating at a peripheral velocity in the opposite direction to that of the photoreceptor belt in a developing region thereon. A peripheral velocity ratio of the peripheral velocity to a moving velocity of the photoreceptor belt is determined so as to maximize a solid component ratio of a developed toner layer on the photoreceptor belt.

12 Claims, 5 Drawing Sheets

LIQUID ELECTROPHOTOGRAPHIC IMAGING SYSTEM WITH A MAXIMIZED SOLID TONER RATIO

BACKGROUND OF THE INVENTION

1. Field of the Invention

The present invention relates to liquid electrophotographic imaging systems, and in particular to a developing apparatus having a developing roller for supplying a latent image substrate with liquid developer and a control method thereof.

2. Description of the Related Art

There has been known a liquid electrophotography using a liquid developer composed of charged toner particles dispersed in a dielectric fluid. An electrostatic latent image formed on a latent image substrate is developed by adhering toner particles to surfaces of the latent image substrate due to electrophoresis. As a liquid developer supplying system, it is generally known that a thin layer of liquid developer is formed on a cylindrical roller or a belt to continuously supply the liquid developer to a developing region of the latent image substrate. In the case of a developing roller, the developing roller is rotated to continuously supply a predetermined amount of liquid developer to the surface of the latent image substrate. In this case, the developing roller also serves as an opposed electrode.

The liquid developer supplied from the developing roller to the latent image substrate forms a meniscus on the developing region of the latent image substrate. In this case, the amount of toner developed on the latent image depends on the amount of liquid developer supplied. Therefore, in order to increase the developing speed, the concentration of solid component of liquid developer supplied is increased or the amount of liquid developer supplied is increased by rotating the developing roller more quickly.

After the developing process has been completed, an image portion on the surface of the latent image substrate is normally composed of toner particles and dielectric fluid. This may cause the shape of image to be liquidly lost or disordered depending on the concentration of the toner. To avoid such an undesired phenomenon and perform the transferring process smoothly, a squeezing process is adopted to squeeze only dielectric fluid from the image portion.

In the squeezing process, there is known such a method that dielectric fluid is squeezed by making a rotating roller touch on the latent image substrate under the high pressure. Also, there is known another method that applies an electric field between the roller and the latent image substrate with a gap to drift toner particles toward the latent image substrate and then removes upper dielectric fluid.

There has been disclosed a liquid image forming apparatus having a single roller used as both a developing roller and a squeezing roller in Japanese Patent Application Unexamined Publication No. 6-186859. In this prior art, the roller rotates in the same direction as that of a photoreceptor drum, allowing excess liquid developer to be removed from the surface of the photoreceptor drum. In addition, a liquid reserving plate is provided over the roller such that it makes contact with the roller, preventing liquid developer from going around the roller.

However, in the described-above prior art, developing can be ensured by: supplying the liquid developer in excess of the minimum required for developing: using a higher concentration of liquid developer; excessively increasing the rotation speed of the roller with respect to the photoreceptor drum; or relatively elongating the developing time using a plurality of rollers. As a result, an increasing amount of liquid developer causes the amount of dielectric fluid contained in it to be also increased.

When the amount of dielectric fluid is increased, a lower concentration of liquid developer comes into contact with the developed portion for a relatively long time. Therefore, a solid component ratio in a toner image after the developing process is reduced, where a solid component ratio is defines as a ratio of toner in a developed portion composed of toner and solvent. As a result, there is a high probability that the developed image is disordered and developer is deposited on an area of an image substrate for background, so that a clear image cannot be obtained.

Moreover, depending on the rotation speed of the developing roller, the image itself is disordered in some cases. In addition, as the solid component ratio of toner layer becomes lower, the higher load such as application of pressure or electric field in the squeezing process is required.

In particular, when the developing roller is shared with the squeegee roller and the liquid reserving plate is provided, the developing region can be exposed to a smaller concentration of liquid developer intercepted by the liquid reserving plate. Therefore, the solid component ratio could not be improved. An increased solid component ratio allows a toner image to be prevented from drifting and the transferring process to be performed smoothly, and in addition, the quality of the final image to be improved.

Thus, even in the above-prior art, the excess liquid developer can be removed from the developed toner image on the surface of the photoreceptor drum. However, the problems such as image drifting and a high load required in squeezing could not been solved. Also, an appropriate amount of liquid developer to obtain clear images has not been defined.

SUMMARY OF THE INVENTION

The inventors found that a developer supplying condition can be optimized so as to maximize the solid component ratio of a developed toner layer, and thereby the disadvantages of the described-above prior art can be solved.

An object of the present invention is to provide a liquid electrophotographic developing apparatus thereof capable of preventing image drift and reducing the load in the squeezing process.

According to the present invention, a developing apparatus develops an electrostatic latent image on a latent image substrate using a liquid developer in which toner particles are dispersed in a dielectric fluid, wherein the latent image substrate moves at a predetermined velocity in a first direction The developing apparatus includes: a developing roller facing the latent image substrate with a predetermined spacing, for supplying the liquid developer to the latent image substrate while rotating at a peripheral velocity in a second direction, wherein the second direction is opposite to the first direction in a developing region on the latent image substrate, wherein a peripheral velocity ratio of the peripheral velocity of the developing roller to the predetermined velocity of the latent image substrate is determined so as to maximize a solid component ratio of a developed toner layer on the latent image substrate.

A peak peripheral velocity ratio (kt) providing a maximum solid component ratio of a developed toner layer may be represented by $$kt=(2mt/L\rho c)+1,$$

where mt is a saturated amount of developed toner, L is a length of the predetermined spacing, ρ is a density of the liquid developer, and c is concentration of the liquid developer.

The peripheral velocity ratio (k) may be set to a value ranging from 0.8kt to 1.2kt.

A peak peripheral velocity ratio (kt) providing a maximum solid component ratio of a developed toner layer may be represented by $$kt = \frac{mt + \sqrt{mt^2 + 2mtLc\rho}}{Lc\rho}$$

where mt is a saturated amount of developed toner, L is a length of the predetermined spacing, ρ is a density of the liquid developer, and c is concentration of the liquid developer. The peripheral velocity ratio (k) may be set to a value ranging from 0.8kt to 1.2kt.

A glass transition temperature of the toner particles dispersed in the dielectric fluid may be equal to or lower than −1° C. The solid component ratio of developed toner layer may be 20 wt % or more.

An image forming apparatus includes: a latent image substrate moving at a predetermined velocity in a first direction; a developing roller facing the latent image substrate with a predetermined spacing, for supplying a liquid developer including toner particles to the latent image substrate while rotating at a peripheral velocity in a second direction, wherein the second direction is opposite to the first direction in a developing region on the latent image substrate; a squeezing roller for squeezing the developed toner layer to produce a toner image on the latent image substrate; and a transfer section for transferring the toner image to another medium, wherein a peripheral velocity ratio of the peripheral velocity of the developing roller to the predetermined velocity of the latent image substrate is determined so as to maximize a solid component ratio of a developed toner layer on the latent image substrate.

An image forming apparatus includes: a photoreceptor belt rotating at a predetermined velocity in a first direction; a plurality of developing devices corresponding to different colors, the developing device being arranged along the first direction, each of the developing devices comprising: a developing roller facing the photoreceptor belt with a predetermined spacing, for supplying a liquid developer including color toner particles to the photoreceptor belt while rotating at a peripheral velocity in a second direction, wherein the second direction is opposite to the first direction in a developing region on the photoreceptor belt; and a squeezing roller for squeezing the developed toner layer to produce a color toner image on the photoreceptor belt: and a transfer section for transferring a multicolor toner image obtained by a sequence of the developing devices to another medium, wherein a peripheral velocity ratio of the peripheral velocity of the developing roller to the predetermined velocity of the photoreceptor belt is determined so as to maximize a solid component ratio of a developed toner layer on the photoreceptor belt.

DESCRIPTION OF THE PREFERRED EMBODIMENTS

Figure 1:
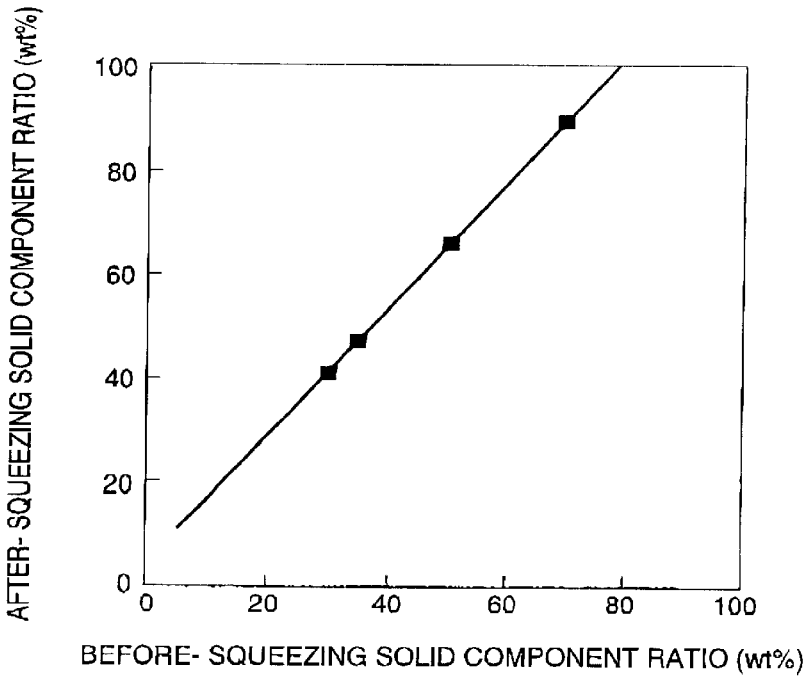
FIG. 1 is a graph showing a relationship between solid component ratios of a developed toner layer before squeezing and after squeezing.

Referring to FIG. 1, conditions for measuring solid component ratios before and after squeezing are as follows. First, a PET (polyethylene terephthalate) film having an aluminum electrode provided on one surface thereof is placed on a brass plate electrode with the aluminum electrode making contact with the brass plate electrode. The surface of PET film is negatively charged to −1000 V by a well-known corona charger and then faces another brass plate electrode in parallel to form a gap of 0.3 mm. Liquid developer is injected into the gap to perform development.

Thereafter, a developed toner layer is horizontally moved at a predetermined speed directly below a corona charger having the same polarity as a charged polarity of the toner, so that the developed toner layer having a predetermined solid component ratio is formed. This developed toner layer is squeezed under a constant line pressure condition, using a urethane rubber roller.

As shown in FIG. 1, the higher the solid component ratio before squeezing, the higher the solid component ratio after squeezing. This means that a load for squeezing can be reduced by increasing the solid component ratio after developing (that is, before squeezing).

First Embodiment

Figure 2:
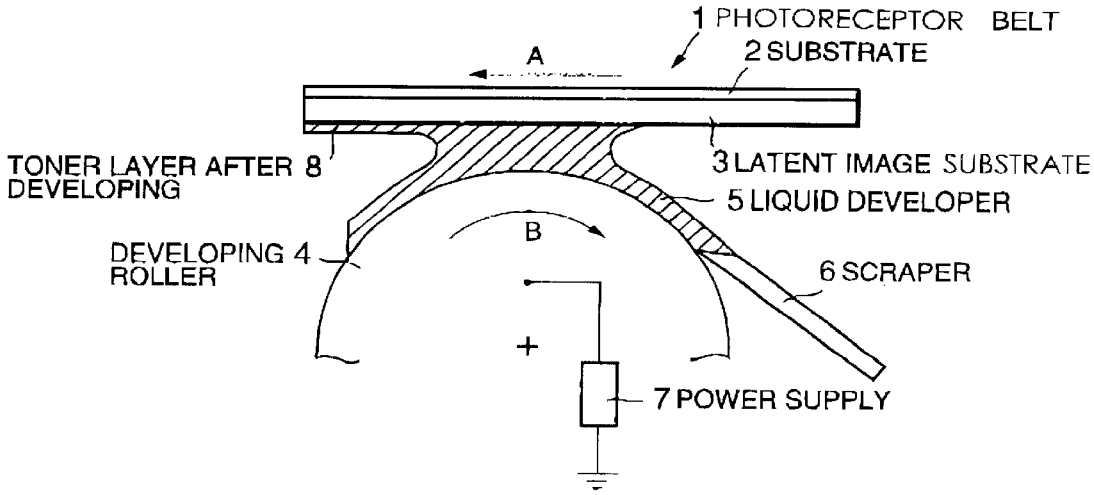
FIG. 2 is a schematic diagram showing a constitution of a liquid electrophotography developing apparatus according to a first embodiment of the present invention.

Referring to the FIG. 2, a photoreceptor belt 1 is composed of a latent image substrate 2 having a latent image substrate film 3 formed thereon. The photoreceptor belt 1 is looped over a plurality of rollers (not shown) to run in the direction indicated by an arrow A by a driving mechanism including a motor (not shown). Here, a moving speed of the photoreceptor belt 1 is set at 70 mm/sec.

A developing roller 4 is provided under the photoreceptor belt 1 with facing the latent image substrate film 3 such that a predetermined gap is formed between the photoreceptor belt 1 and the developing roller 4. Here, the developing roller 4 is made of SUS with an external diameter of 20 mm. The gap between the photoreceptor belt 1 and the developing roller 4 is set at 120 $\mu$m.

The developing roller 4 rotates in the direction indicative of an arrow B. In the developing region, the periphery moving direction B of the developing roller 4 is opposite to the moving direction A of the photoreceptor belt 1 as shown in FIG. 2.

A liquid developer 5 containing toner particles and dielectric fluid is supplied from the surrounding surface of the developing roller 4 to the photoreceptor belt 1. The positively charged toner particles are used as a solid component of the liquid developer 5, and NORPAR12 (made by EXXON Corp.) is used as the dielectric fluid. The solid component ratio of toner is 2 to 5 wt %.

Moreover, a reference numeral 6 is a scraper whose top edge is pressed against the developing roller 4 and is used for scratching off the liquid developer 5 from the surface of developing roller 4. A reference numeral 7 is a power supply to apply a bias voltage to the developing roller 4. The bias voltage is set to 450 V.

The photoreceptor belt 1 is positively charged over the surface of the latent image substrate film 3 by the charger (not shown). Subsequently, the positively charged surface of the latent image substrate film 3 is exposed to a laser light beam emitted from an exposer (not shown) and thereby an electrostatic latent image is formed thereon. Here, the potential of exposed sections of the electrostatic latent image is 100 V, and that of non-exposed sections is 800 V.

In this way, the electrostatic latent image is formed on the photoreceptor belt 1, and the photoreceptor belt 1 moves further to pass over the developing roller 4. The developing roller 4 rotates in the direction B opposing to the photoreceptor belt 1 and the liquid developer 5 on the developing roller 4 is supplied to the latent image portion of photoreceptor belt 1 in accordance with the rotating operation of developing roller 4. As a result, toner particles contained in the liquid developer 5 are drifted to the exposed sections to be developed on the photoreceptor belt 1. A reference numeral 8 shows the toner layer after the developing process.

Here, an amount of solid component obtained by removing the dielectric fluid from the toner layer 8 after the developing process and a solid component ratio are measured using a weight analysis. According to the developing condition in the developing apparatus as shown in FIG. 2, an amount of toner required for an all-over developed image on paper is 0.28 mg/cm$^2$. According to an image formation condition in the present invention, the amount of developed toner on the photoreceptor belt was approximately equal to the amount of toner of image section transferred to a paper.

First, the followings were measured: a peripheral velocity ratio of the developing roller 4 with use of liquid developer of 3 wt % in concentration; and the amount of toner and the solid component ratio per unit area of the all-over developed image section after the developing process. A peripheral velocity is defined as a ratio of the rotation speed of developing roller 4 with respect to the moving speed of photoreceptor belt 1. In other words, a rotation velocity ratio may be used as a peripheral velocity. The measurement results are shown in FIG. 3.

Figure 3:
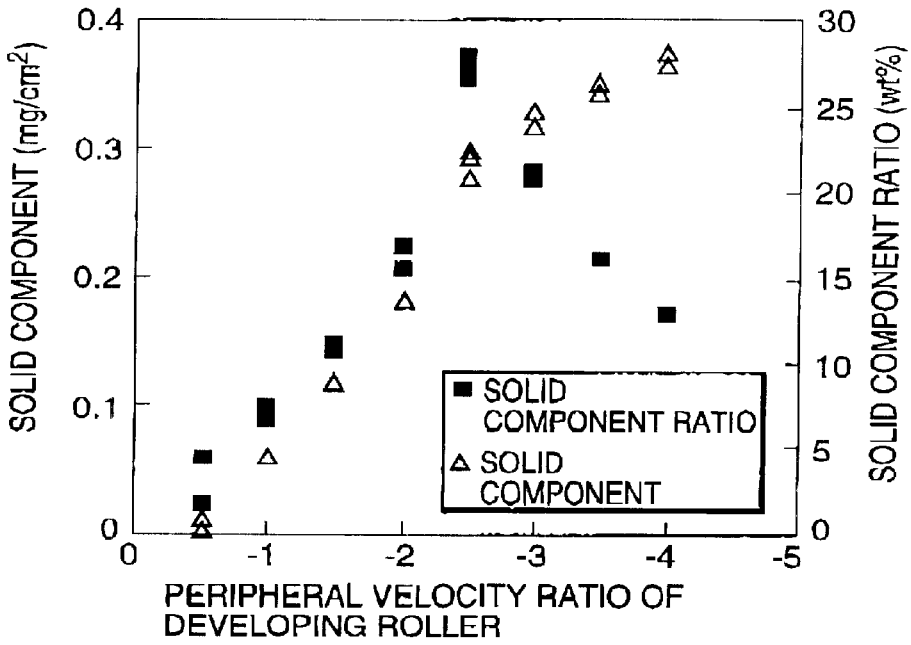
FIG. 3 is a diagram showing a relationship between the peripheral velocity ratio, an amount of toner after developing and the solid component ratio when a developing roller rotates in the opposite direction to the movement direction of an latent image substrate.

A horizontal axis of FIG. 3 shows the peripheral velocity ratio (or a rotation velocity ratio) of developing roller 4. In this case, since the developing roller 4 is moving in the opposite direction to the photoreceptor belt 1, the peripheral velocity ratio is represented as a negative number. A vertical axis of FIG. 3 shows the solid component ratio and the amount of solid component. As is apparently shown in FIG. 3, when the peripheral velocity ratio of developing roller 4 becomes approximately 2.5, the amount of solid component changes in dependence on peripheral velocity ratio. When the peripheral velocity ratio becomes 2.5 or more, the dependence on peripheral velocity ratio becomes small, compared with the case of peripheral velocity ratio of 2.5 or less.

Moreover, the solid component ratio reaches a peak at the peripheral velocity ratio of 2.5 while the slope of the amount of solid component is changed and the amount of solid component reaches a very high value of 25 wt % at the same peripheral velocity ratio of 2.5 as shown in the graph of FIG. 3. Therefore, if the peripheral velocity ratio of developing roller 4 is configured at the vicinity of a maximum point so that the solid component ratio reaches the peak, the maximum solid component ratio can be obtained.

The peripheral velocity ratio showing this maximum point was investigated in detail. Here, in the case where the developing roller 4 rotates in the direction A (forward direction) that is the same as the moving direction of the photoreceptor belt 1, the solid component ratio of developed toner layer and a dependence of the amount of solid component on peripheral velocity ratio in were also investigated. The measurement results are shown in FIG. 4.

Figure 4:
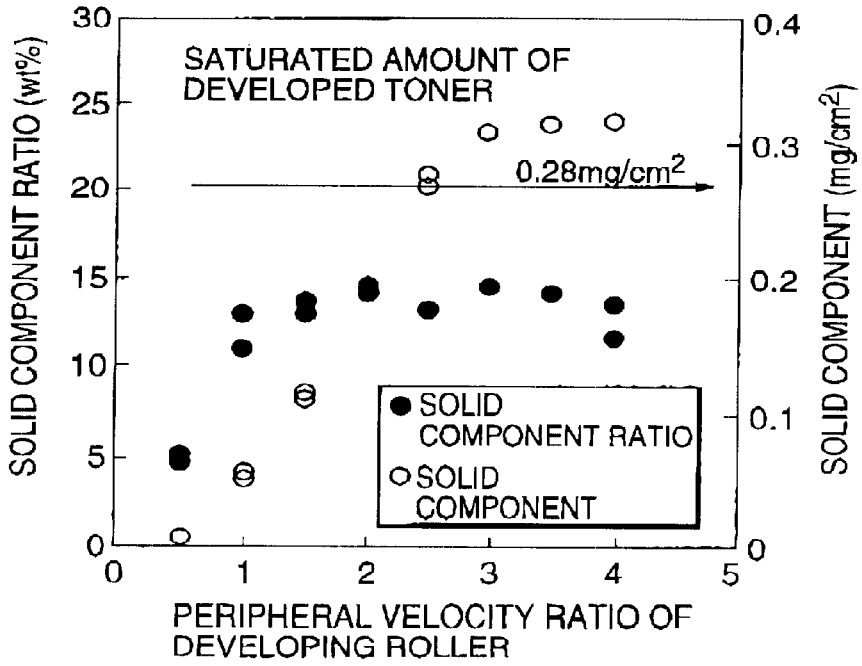
FIG. 4 is a diagram showing a relationship between the peripheral velocity ratio, an amount of toner after developing and the solid component ratio when a developing roller rotates in the forward direction.

Referring to FIG. 4, when the developing roller rotates in the forward direction A, the amount of solid component becomes saturated at approximately 3, differing from the case of rotating the developing roller 4 in the opposite direction B. The saturated amount of developed toner in this case is 0.28 mg/cm$^2$ and it is the amount of toner required to print the all-over developed image. This value was approximately the same value as the amount of developed toner when the surface of photoreceptor belt 1 is exposed to the liquid developer for a long time under the same potential condition. That is, the amount of developed toner is considered to be sufficient to cancel completely the applied electric field between the photoreceptor belt 1 and the developing roller 4 on the developing process.

Moreover, when the developing roller 4 rotates at a peripheral velocity ratio in the opposite direction B providing the maximum solid component ratio, the amount of solid component is approximately the same as the saturated amount of developed toner (0.28 mg/cm$^2$), as shown in FIG. 3. Furthermore, the peripheral velocity ratio at which the amount of developed toner reaches saturation is also same between rotating in the forward direction A and in the opposite direction B, as shown apparently in FIG. 3 and FIG. 4.

As described above, when the developing roller 4 is rotated in the reverse direction, the peak of solid component ratio of toner layer 8 after developing can be achieved at the peripheral velocity ratio to match with the amount of development.

Figure 5:
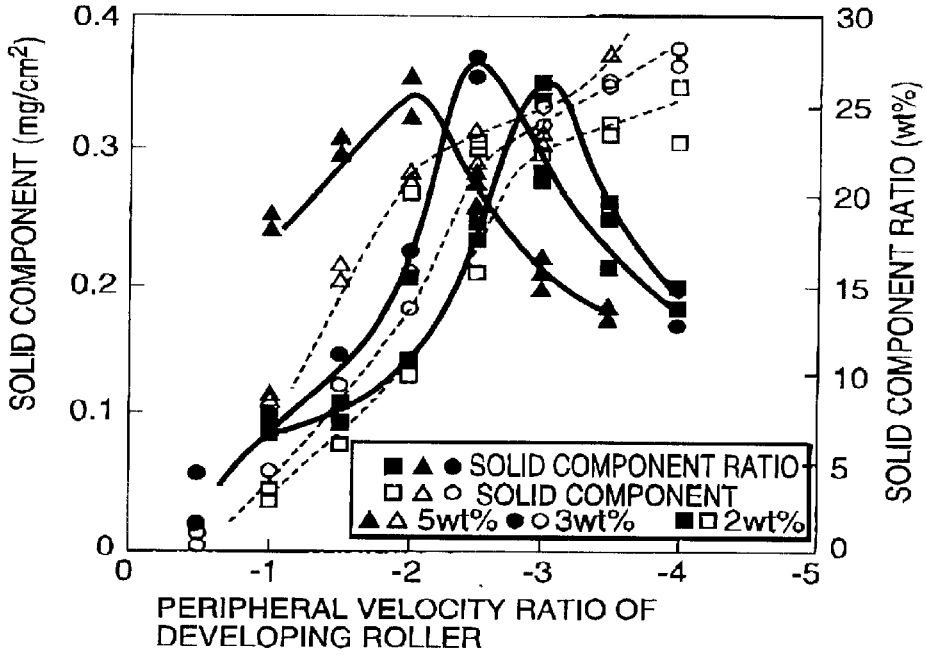
FIG. 5 is a diagram showing a relationship between the peripheral velocity ratio, an amount of toner after developing and the solid component ratio, using the concentration of a developer as a parameters when a developing roller rotates in the opposite direction.

FIG. 5 shows the results of similar experiment performed rising the concentration of developer as a parameter. The horizontal axis of FIG. 5 shows the peripheral velocity ratio (the rotation velocity ratio) of developing roller 4, and the vertical axis shows the amount of solid component and the solid component ratio after developing.

The experiments were performed under three concentrations of developer: 2 wt %, 3 wt %, and 5 wt %. As shown clearly in FIG. 5, the solid component ratio reaches the peak value, respectively, at the peripheral velocity ratio of 2 when the concentration of the developer is 2 wt %, at the peripheral velocity ratio of 3 when the concentration of the developer is 5 wt %, and at the same time, the amount of solid component shows approximately 0.28 mg/cm$^2$ of the saturated amount of developed toner under this potential condition. Therefore, as shown in the described-above results, the solid component ratio can be maximized by setting a supplying condition of liquid developer so as to satisfy a certain predefined amount of developed toner, independently of the concentration of developer.

Such a supplying condition will be further described. It is considered that, in the meniscus portion of developing region as shown in FIG. 2, a velocity distribution (a distribution of a velocity of flow) as shown in FIG. 6 occurs in the developing gap depending on the moving speed of photoreceptor belt 1 and the moving speed of developing roller 4.

Figure 6:
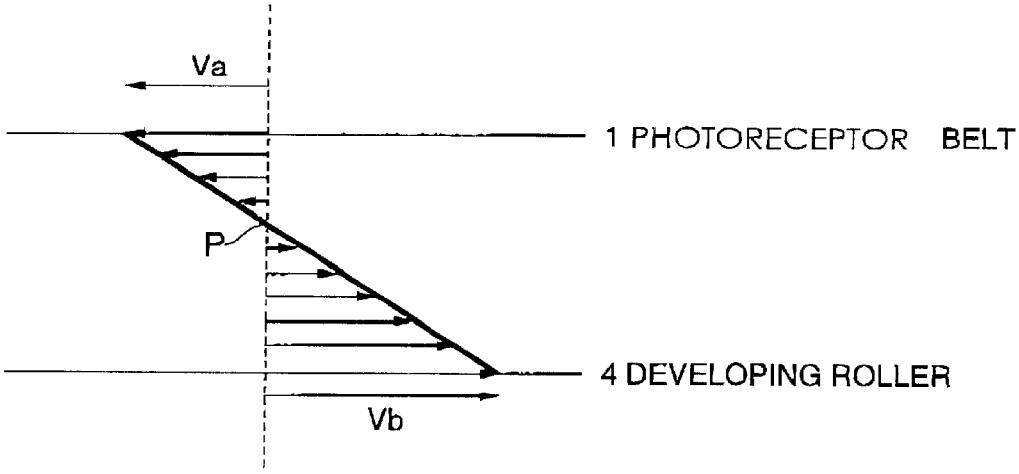
FIG. 6 is a diagram showing a distribution of a flow velocity of the liquid developer within a developing gap.

As shown in FIG. 6, when the moving speed of photoreceptor belt 1 is Va and the moving speed of developing roller 4 is Vb, the velocity distribution in the developing gap is formed so that the velocity of flow is continuously changed from Va in the side of photoreceptor belt 1 to Vb in the side of developing roller 4. In this velocity distribution, the liquid developer carried by the developing roller 4 includes a portion that cannot pass substantially through the developing gap. This excess liquid developer forms a developer reservoir in the portion to inject the developer or overflow from the end of developing roller 4. Therefore, even if the rotation speed or developing roller 4 was increased or the concentration of liquid developer was raised, the amount of liquid developer to be supplied is substantially restricted.

Here, the amount of liquid developer to substantially pass through the developing gap is calculated quantitatively.

Figure 7:
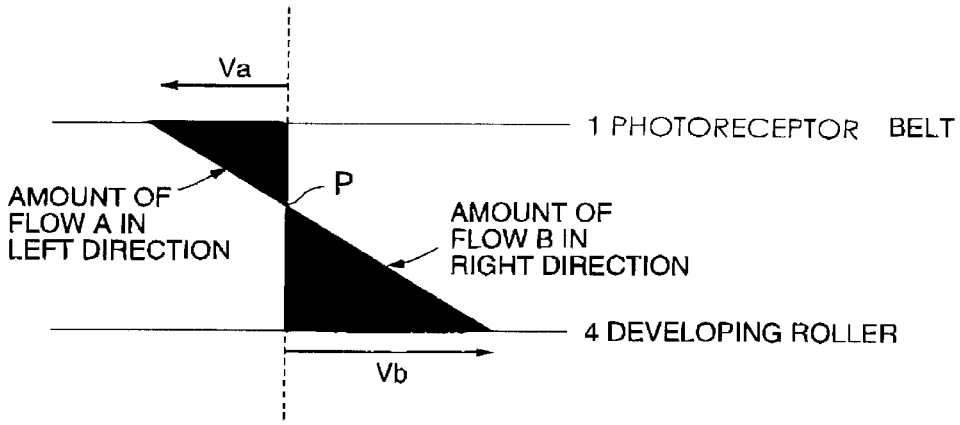
FIG. 7 is a diagram illustrating an amount of liquid developer passing through the developing gap.

Assuming the case having the velocity distribution as shown in FIG. 6, the amount of liquid developer per unit time passing across the cross section of developing gap shown by dashed line in FIG. 7, can be represented as a difference between region A and region B. Here, the amount of flow per unit time to pass across the dashed cross section is determined by the shape formed by the straight line representing velocity distribution and the cross section of developing gap shown by dashed line as shown in FIG. 7. Moreover, this amount to pass across the cross section is considered to be the effectively available amount in the developing region. What corresponds to this amount is an area of the portion of B-A. The length of developing gap is defined as L. Since the developing gap is divided into proportions Va:Vb at the point P, at which the line of velocity distribution intersects the cross section, A and B can be represented by $$A=(1/2)Va\cdot Va/(Va+Vb)L \quad (1) \text{ and}$$

$$B=(1/2)Vb\cdot Vb/(Va+Vb)L \quad (2).$$

Therefore, B−A becomes $$B-A=1/2(Vb^2-Va^2)/(Va+Vb)L=1/2(Vb-Va)L \quad (3)$$

From the described-above results, the optimum peripheral velocity ratio is made at the time when the amount of toner contained in this liquid developer becomes equal to the saturated amount of toner developed per unit time. Therefore, assuming that the density of liquid developer is ρ, the concentration is c, and the saturated amount of developed toner in a predetermined development potential difference is mt, the following relationship can be satisfied:

$$1/2\cdot(Vb-Va)Lc\rho=mt\cdot Va \quad (4).$$

Therefore, when dividing these sides by Va, $$1/2\cdot(kt-1)Lc\rho=mt \quad (5)$$

is obtained, where peripheral velocity ratio: Vb/Va=kt. Accordingly, this peripheral velocity ratio kt can be represented as $$kt=(2mt/L\rho c)+1 \quad (6).$$

This is the peripheral velocity ratio that maximizes the solid component ratio of toner layer after developing.

Moreover, calculating the supplying amount of liquid developer in this condition using the formula (3), it matched with the saturated amount of developed toner. Therefore, the formula (3) is supported to show accurately the optimum supplying amount of liquid developer.

Figure 8:
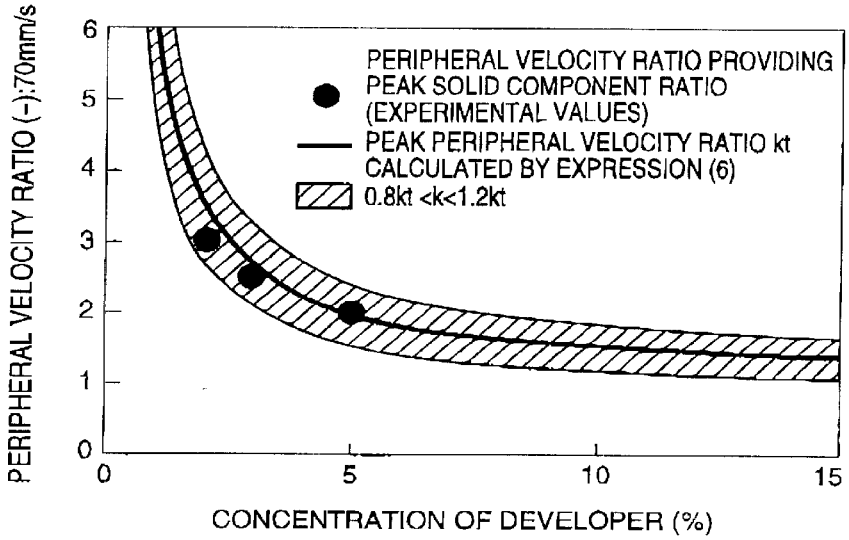
FIG. 8 is a diagram showing the peripheral velocity ratio at which a development toner layer maximizing the solid component ratio can be obtained, with respect to a concentration of the developer.

Furthermore, the peripheral velocity ratio kt, which leads to the peak of solid component ratio for the concentration of liquid developer, is calculated by the formula (6), and the result is plotted in FIG. 8.

In FIG. 8, the actual peripheral velocity ratio to maximize the solid component ratio is shown by black dots (experimental values). The diagonally shaded area in FIG. 8 shows the range of peripheral velocity ratio to meet 0.8kt<k<1.2 kt in respective concentrations. It is apparently shown in FIG. 8 that the experimental value of solid component ratio calculated by the formula (6) is optimum. It is also verified that the solid component ratio can be increased to 20 wt % or more by setting the peripheral velocity ratio k within the range of 0.8kt<k<1.2kt.

Second Embodiment

In a second embodiment of the present invention, the calculating method of peripheral velocity ratio is different from the first embodiment. All except for it is same as in the first embodiment.

Similarly to the first embodiment, the substantial amount of liquid developer to pass through the developing gap is calculated. In this embodiment, the velocity distribution as shown in FIG. 6 is considered. Here, the velocity distribution assumed in this embodiment is the same as in the first embodiment. The amount of liquid developer per unit time, which passes across the cross section of developing gap to be shown by dashed line in FIG. 7 and is supplied to the developing region, is represented as the amount of flow moving in the same direction as the developing roller of FIG. 7.

As described above, the speed of latent image substrate 1 is defined as Va, and the speed of developing roller 4 is defined as Vb. The amount of flow per unit time to pass across the cross section of dashed line is represented as the shape formed by the straight line and the cross section representing the velocity distribution as shown in FIG. 7, that is as the width of region B only. In this embodiment, the amount of toner supplied to this cross section is considered to be effectively available for the developing region. A length of the developing gap is defined as L. The developing gap A is divides into proportions Va:Vb at the point P where the line of velocity distribution intersects the cross section. Accordingly, a relationship of $$B=(½)Vb\cdot Vb/(Va+Vb)L \quad (7)$$

can be made in the same manner as the formula (2). The optimum peripheral velocity ratio is made at the time when the amount of toner contained in this liquid developer becomes equal to the saturated amount of toner developed per unit time. Accordingly, when defining the density of liquid developer as ρ, the concentration as σ, and the saturated amount of developed toner in a predetermined development potential difference as mt, a relationship of $$(½)Vb\cdot Vb/(Va+Vb)L\cdot\rho\cdot c=mt\cdot Va \quad (8)$$

can be made. Accordingly, assuming that the peripheral velocity ratio is Vb/Va=kt, the expression (8) can be rearranged with respect to kt to form the following:

$$L\rho c\cdot kt^2-2mt\cdot kt-2mt=0 \quad (9).$$

Accordingly, this peripheral velocity ratio kt can be represented as $$kt=\frac{mt+\sqrt{mt^2+2mtLc\rho}}{Lc\rho}. \quad (10)$$

This is the peripheral velocity ratio maximizing the solid component ratio of toner layer after developing in the same manner.

Here, the supplying amount of liquid developer calculated by the formula (7) matched with the saturated amount or developed toner.

Figure 9:
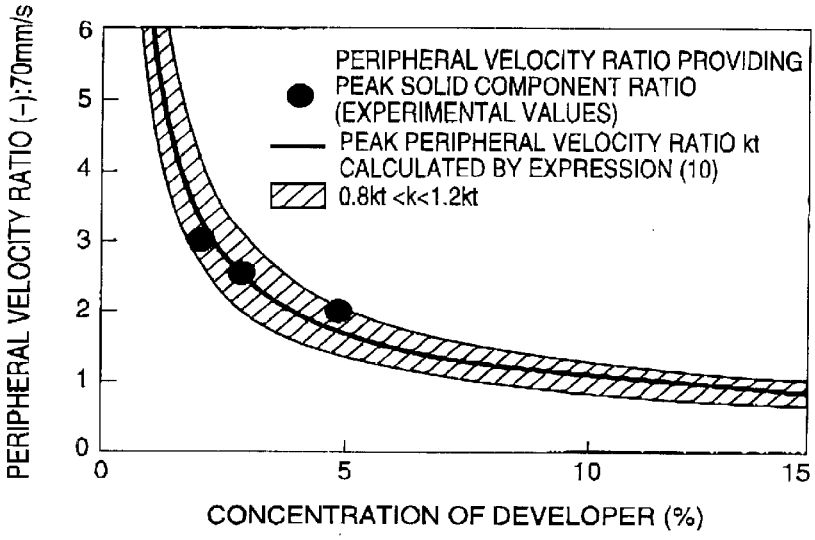
FIG. 9 is a diagram showing the peripheral velocity ratio at which a development toner layer maximizing the solid component ratio can be obtained, with respect to a concentration of the developer in a control method according to a second embodiment of the present invention.

In FIG. 9, the peripheral velocity ratio kt providing the peak of solid component ratio for the concentration of liquid developer is calculated by the formula (10) and the results are plotted. The actual peripheral velocity ratio to maximize the solid component ratio is shown by black dots in FIG. 9. The diagonally shaded area represents the range of peripheral velocity ratio k to meet 0.8kt<k<1.2kt in each concentration of developer.

In FIG. 9, it is apparently found that the peripheral velocity ratio calculated by the formula (10) is the maximized experimental value of solid component ratio. It also becomes apparent that the peripheral velocity ratio calculated by the formula (10) is optimal, even in varying the concentrations of developer. In this case as well, the ideal solid component ratio can be 20 wt % or more as shown in FIG. 3 and the like. Contrary to this, it was confirmed that the solid component ratio can be increased to 20 wt % or more by setting the peripheral velocity ratio k within the range of 0.8kt<k<1.2kt.

The results obtained in FIGS. 8 and 9 will be described. First, the liquid developer is injected into the predetermined developing gap by the developing roller 4, and a meniscus is formed in the developing region. When the meniscus is formed, the electric field is effectively applied to the region of developing gap and thereby development occurs due to electrophoresis.

At this time, in the developing region, the differences in flowing velocity occur bi-directionally because the surface of the latent image substrate 1 and the peripheral surface of the developing roller 4 are moved in opposite directions to each other. The flow-velocity differences cause only the liquid developer on developing roller 4 to be effectively supplied to the developing region in a predetermined ratio. The toner particles contained in the supplied liquid developer develops the latent image on the latent image substrate 1.

Based on such thought, calculating the right amount of liquid developer to be supplied, the amount of toner included therein matched with the saturated amount of developed toner in each concentration as mentioned above. Moreover, the optimum peripheral velocity ratio is specified by the toner concentration of developer and the saturated amount of developed toner. When the peripheral velocity ratio is larger than this specified value, an increased amount of liquid developer is supplied and thereby solution reservoir is produced, so that the developed toner layer is exposed to a low-concentration liquid developer when the developed toner layer exits from the developing region, resulting in rapidly reduced solid component ratio.

As shown in FIGS. 3 and 5, the maximum solid component ratio of toner layer provides the high value of 25 wt %. As for the liquid developer used in this case, when the solid component ratio of toner layer becames 20 wt % or more, problems were remarkably solved, which had occurred in the case of the developed toner layer with low solid portion ratio such as solution dripping and disarrangement of the developed image. It is estimated that, when the amount of liquid developer to be supplied is set to the saturated amount, the liquid developer after developing in the side of developing roller 4 turns out to be almost only NORPAR 12, which hardly contains toner particles.

Under this condition, the excess dielectric fluid is considered to be effectively eliminated because a kind of shear is produced due to the difference in peripheral velocity between the latent image substrate 1 and the developing roller 4. Since the thickness of a toner layer itself is also set at the minimum value, the density of the toner layer also becomes largest, resulting in stronger adherent force between their toners. Therefore, the developing condition with reduced disarrangement of images can be obtained.

In addition, in the subsequent squeezing process as well, the necessary load on the developed toner layer, such as pressure or electric field condition, also can be reduced. In the subsequent transfer process, the satisfactory transfer operation is normally performed without lack of images and drifting images, transferring to a paper or to an intermediate transfer medium with the force of electric field. Since the adherent force and sticky force of toner are sufficiently high, the transfer operation can be performed under low pressure. As the toner particles move at higher speed than in the case of the electrophoresis transfer with the electric field, the printing can be performed at a high speed. A remarkable effect, to stabilize the toner layer after developing and take off the load in the squeezing process and the transfer process, can be obtained by setting the peripheral velocity ratio k within the range of 0.8kt<k<1.2kt.

It should be noted that a drum-shaped photoreceptor may be used as the latent image substrate in place of belt-shaped one.

Here, the described-above experiments used the liquid developer, which is capable of film forming by reducing the solvent described in U.S. Pat. No. 5,650,253 or U.S. Pat. No. 5,698,616. A film-forming liquid developer is a liquid developer in which small particulates composed of minute substances and color material, having a glass transition point (temperature) lower than a room temperature are dispersed into a dielectric fluid.

In normal state, these small particulates are not made contact with each other and aggregated. However, when removing the carrier liquid, there remains only the substances, which adhere and combine in a room temperature to film forming. These minute substances can be obtained by compounding ethylalcohol and methylmethacrylate. The glass transition temperature can be determined depending on their compounding ratio. In this case, one with the glass transition temperature of −1° C. is used. Moreover, NORPAR12 (provided by EXXON Corp.) is used as a solution carrier. Moreover, other liquid developers can be also used, such that the particulates composed essentially of heat melting fixation type resin such as polyester and polystyrene are dispersed in the dielectric fluid.

Color Image Forming Apparatus

Figure 10:
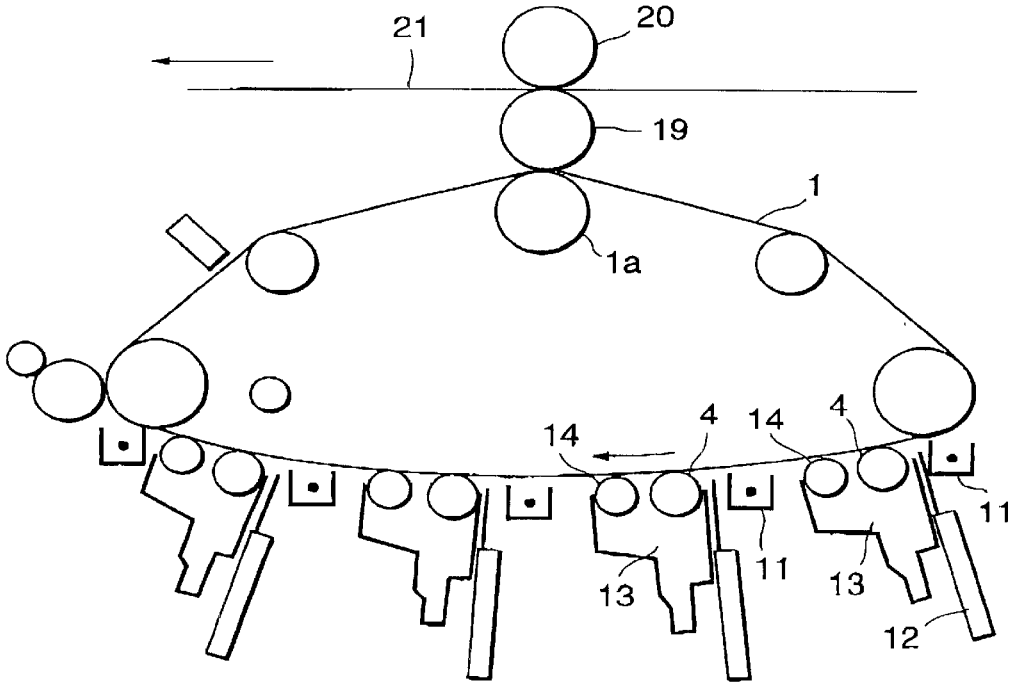
FIG. 10 is a diagram showing an example of an image forming apparatus using the liquid electrophotography developing apparatus according to the present invention.

Referring to FIG. 10, the photoreceptor belt 1 that is the same as one in FIG. 2 is looped over a plurality of rollers, which are driven to run the photoreceptor belt 1 by a driving mechanism including a motor or the like (not shown). The photoreceptor belt 1 rotates in the direction indicated by an arrow.

Under the photoreceptor belt 1, four devices are arranged, each device being composed of a charger 11, a laser light source 12, and a developing device 13 having a developing roller 4 and a squeezing roller 14 provided therein. In this embodiment, an image is formed with four colors, which are provided by the four devices, respectively. The liquid electrophotography developing apparatus described in the first and second embodiments is used as the developing device 13.

On the top of the photoreceptor belt 1, an intermediate transfer medium (a transfer roller) 19 and a fixing roller 20 are provided such that the transfer roller 19 makes contact with the photoreceptor belt 1 and a recording medium 21 is sandwiched and conveyed by the transfer roller 19 and the fixing roller 20.

When an image is formed, the photoreceptor belt 1 is charged by the first charger 11 and is subsequently exposed with a laser light beam to produce a first color latent image on the photoreceptor belt 1. The first color is developed by the developing roller 4 and then the squeezing process is performed by the squeezing roller 14. In this way, the first colored toner image is developed on the photoreceptor belt 1. Hereafter, in the same manner, a second colored toner image, a third colored toner image and so on are sequentially developed by corresponding devices arranged along the moving direction of photoreceptor belt 1.

After forming a fourth colored toner image, the toner image on photoreceptor belt 1 is transferred to the intermediate transfer medium 19. This toner image transfer operation can be performed by only the pressure generated by a driving roller 1*a* and the intermediate transfer medium 19. While, the recording medium 21 is fed between the intermediate transfer medium 19 and a fixing roller 20 from a paper feeding section (not shown) in synchronization with this transfer operation. When the recording medium 21 passes through between these both rollers 19 and 20, the toner image on the intermediate transfer medium 19 is transferred and fixed to the recording paper by the pressure of intermediate transfer medium 19 and fixing roller 20. And then, the recording medium 21 is ejected through an outlet (not shown) outside the apparatus.

In this embodiment, the liquid electrophotography developing apparatus as shown in FIG. 2 is used as the developing device 13. According to this constitution, the amount of excess liquid developer can be dramatically reduced. Even if squeezing is performed by the squeezing roller 14 after developing each color, each color image can be excellently overlaid on another color image without dripping of toner and color mixture.

In contrast, according to a prior art, the solid component ratio of toner layer after developing cannot be increased in order to overlay different colors. Therefore, the load in the squeezing process becomes very high. According to the present invention, the squeezing load can be reduced by a large amount.

Furthermore, in the prior art, color images are transferred to the intermediate transfer medium one by one, and therefore, it is necessary to rotate the photoreceptor belt 1 four times to form the four-colored image, resulting in deteriorated registration in color overlaying.

According to the present apparatus, however, since the solid component ratio of toner layer can be maximized as mentioned above, good registration can be easily achieved. As a result, the good multicolored toner image can be formed by one-time rotation of photoreceptor belt 1, and the time required to form the image can be shortened.

Further, transfer efficiency can be effectively improved by supplemental application of electric field in addition to pressure when the toner image of photoreceptor belt 1 is transferred to the intermediate transfer medium 19. Instead of the photoreceptor belt 1, the drum-shaped photoreceptor may be also used. Moreover, in fixing process, heat may be added. Furthermore, the toner image of photoreceptor belt 1 may be transferred directly to the recording medium without using the intermediate transfer medium.

As described above, according to the present invention, the amount of liquid developer to pass through the developing gap is equalized to the amount of toner required in the all-over developed image (a saturated amount of developed toner). The excess amount of liquid developer in the developing region can be reduced, and the solid component ratio of toner layer after developing can be maximized. Therefore, the excess liquid developer cannot be exposed to a latent image substrate, and thereby developer can be prevented from being deposited on a white original surface. Moreover, after the developing process, the load in a squeezing process such as pressure or electric field application can be reduced. Furthermore, since image defects such as drifting images and the disarrangement of image do not occur in transferring, the sufficient quality of image can be achieved. When a multicolored image is formed, registration can be performed without dripping toner and mixing color. Furthermore, as the image with a plurality of colors can be formed by one-time rotation of photoreceptor belt 1, the multicolored image can be formed in a shorter time.

What is claimed is:

1. A developing apparatus for developing an electrostatic latent image on a latent substrate using a liquid developer in which toner particles are dispersed in a dielectric fluid, wherein the latent image substrate moves at a predetermined velocity in a first direction, comprising:

a developing roller facing the latent image substrate with a predetermined spacing, for supplying the liquid developer to the latent image substrate while rotating at a peripheral velocity in a second direction, wherein the second direction is opposite to the first direction in a developing region on the latent image substrate, wherein a peripheral velocity ratio of the peripheral velocity of the developing roller to the predetermined velocity of the latent velocity image substrate is determined so as to maximize a solid component ratio of a developed toner layer on the latent image substrate, wherein a peak peripheral velocity ratio (kt) providing a maximum solid component ratio of a developed toner layer is represented by $$kt=(2mt/L\rho c)+1,$$

wherein mt is a saturated amount of developer toner, L is a length of the predetermined spacing, ρ is a density of the liquid developer, and c is concentration of the liquid developer.

2. The developing apparatus according to claim 1, wherein the peripheral velocity ratio (k) is set to a value ranging from 0.8kt to 1.2kt.

3. The developing apparatus according to claim 1, wherein a glass transition temperature of the toner particles dispersed in the dielectric fluid is equal to or lower than −1° C.

4. The developing apparatus according to claim 1, wherein the solid component ratio of developed toner layer is at least 20 wt %.

5. A developing apparatus for developing an electrostatic latent image substrate using a liquid in which toner particles are dispersed in a dielectric fluid, wherein the latent image substrate moves at a predetermined velocity in a first direction, comprising:

a developing roller facing the latent image substrate with a predetermined spacing, for supplying the liquid developer to the latent image substrate while rotating at a peripheral velocity in a second direction, wherein the second direction is opposite to the first direction in a developing region on the latent image substrate, wherein a peripheral velocity ratio of the peripheral velocity of the developing roller to the predetermined velocity of the latent image substrate is determined so as to maximize a solid component ratio of a developed toner layer on the latent image substrate, wherein a peak peripheral velocity ratio (kt) providing a maximum solid component ratio of a developed toner layer is represented by $$kt = \frac{mt + \sqrt{mt^2 + 2mtLc\rho}}{Lc\rho}$$

wherein mt is a substrated amount of developed toner, L is a length of the predetermining spacing, ρ is a density of the liquid developer, and c is a concentration of the liquid developer.

6. The developing apparatus according to claim 5, wherein the peripheral velocity ratio (k) is set to a value ranging from 0.8kt to 1.2kt.

7. The developing apparatus according to claim 5, wherein a glass transition temperature of the toner particles dispersed in the dielectric fluid is equal to or lower −1° C.

8. The developing apparatus according to claim 5, wherein the solid component ratio of developed toner layer is at least 20 wt %.

9. An image forming apparatus comprising:

a latent image substrate moving at a predetermined velocity in a first direction;

a developing roller facing the latent image substrate with a predetermined spacing, for supplying a liquid developer including toner particles to the latent image substrate while rotating at a peripheral velocity in a second direction, wherein the second direction is opposite to the first direction in a developing region on the latent image substrate;

a squeezing roller for squeezing the developed toner layer to produce a toner image on the latent image substrate; and a transfer section for transferring the toner image to another medium, wherein a peripheral velocity ratio of the peripheral velocity of the developing roller to the predetermined velocity of the latent image substrate is determined so as to maximize a solid component ratio of a developed toner layer on the latent image substrate, wherein a peak peripheral velocity ratio (kt) providing a maximum solid component ratio of a developed toner is represented by $$kt=(2mt/L\rho c)+1,$$

wherein mt is a substrated amount of developed toner, L is a length of the predetermined spacing, ρ is a density of the liquid developer, and c is concentration of the liquid developer.

10. An image forming apparatus comprising:

a latent image substrate moving at a predetermined velocity in a first direction;

a developing roller facing the latent image substrate with a predetermined spacing, for supplying a liquid developer including toner particles to the latent image substrate while rotating at a peripheral velocity in a second direction, wherein the second direction is opposite to the first direction in a developing region on the latent image substrate;

a squeezing roller for squeezing the developed toner layer to produce a toner image on the latent image substrate; and a transfer section for transferring the toner image to another medium, wherein a peripheral velocity ratio of the peripheral velocity of the developing roller to the predetermined velocity of the latent image substrate is determined so as to maximize a solid component ratio of a developed toner layer on the latent image substrate, wherein a peak peripheral velocity ratio (kt) providing a maximum solid component ratio of a developed toner is represented by $$kt = \frac{mt + \sqrt{mt^2 + 2mtLc\rho}}{Lc\rho}$$

wherein mt is a substrated amount of developed toner, L is a length of the predetermined spacing, ρ is a density of the liquid developer, and c is concentration of the liquid developer.

11. An image forming apparatus comprising:

photoreceptor belt rotating at a predetermined velocity in a first direction;

a plurality of developing devices corresponding to different colors, the developing device being arranged along the first direction, each of the developing devices comprising:

a developing roller facing the photoreceptor belt with a predetermined spacing, for supplying a liquid including color toner particles to the photoreceptor belt while rotating at a peripheral velocity in a second direction, wherein the second direction is opposite of the first direction in a developing region on the photoreceptor belt; and squeezing roller for squeezing toner layer to produce a color toner image on the photoreceptor belt; and a transfer section for transferring a multicolor toner image obtained by a sequence of the developing devices to another medium, wherein a peripheral velocity ratio of the peripheral velocity of the developing roller to the predetermined velocity of the photoreceptor belt is determined so as to maximize a solid component ratio of a developed toner layer on the photoreceptor belt, wherein a peak peripheral velocity ratio (kt) providing a maximum solid component ratio of a developed toner layer is represented by $$kt=(2mt/L\rho c)+1.$$

where mt is a saturated amount of developed toner, L is a length of the predetermined spacing, ρ is a density of the liquid developer, and c is concentration of the liquid developer.

12. An image forming apparatus comprising:

a photoreceptor belt rotating at a predetermined velocity in a first direction;

a plurality of developing devices corresponding to different colors, the developing device being arranged along the first direction, each of the developing devices comprising:

a developing roller facing the photoreceptor belt with a predetermined spacing, for supplying a liquid developer including color toner particles to the photoreceptor belt while rotating at a peripheral velocity in a second direction, wherein the second direction is opposite to the first direction in a developing region on the photoreceptor belt; and a squeezing roller for squeezing the developed toner layer to produce a color toner image on the photoreceptor belt; and a transfer section for transferring a multicolor toner image obtained by a sequence of the developing devices to another medium, wherein a peripheral velocity ratio of the peripheral velocity of the developing roller to the predetermined velocity of the photoreceptor belt is determined so as to maximize a solid component ratio of a developed toner layer on the photoreceptor belt, wherein a peak peripheral velocity ratio (kt) providing a maximum solid component ratio of a developed toner is represented by $$kt = \frac{mt + \sqrt{mt^2 + 2mtLc\rho}}{Lc\rho}$$

where mt is a saturated amount of developed toner, L is a length of the predetermined spacing, ρ is a density of the liquid developer, and c is concentration of the liquid developer.

* * * * *